United States Patent [19]

Keller

[11] 4,074,252

[45] Feb. 14, 1978

[54] HAND SAFETY FLASHER

[75] Inventor: Herman F. Keller, Newton, Kans.

[73] Assignees: Leon Nikkel; Kermit Nikkel, both of Canton; Lelus B. Brown, Newton, all of Kans. ; part interest to each

[21] Appl. No.: 688,484

[22] Filed: May 20, 1976

[51] Int. Cl.[2] ..... G08B 23/00

[52] U.S. Cl. ..... 340/321; 340/107; 340/331

[58] Field of Search ..... 340/321, 107

[56] References Cited

U.S. PATENT DOCUMENTS

| | | | |
|---|---|---|---|
| 2,090,293 | 8/1937 | Haines | 340/321 |
| 2,363,825 | 11/1944 | Yardeny | 340/321 |
| 2,825,898 | 3/1958 | Stanley | 340/321 |
| 3,114,143 | 12/1963 | Robinson | 340/321 |

*Primary Examiner*—Thomas B. Habecker

*Attorney, Agent, or Firm*—Clarence A. O'Brien; Harvey B. Jacobson

[57] ABSTRACT

A hand safety flasher for use in directing traffic by construction workers, at school crossings, by police, and so forth, comprises a hand-held receptacle for containing a plurality of flashlight cells together with a double lens safety structure having a light bulb contained therein and a flasher structure between the series connected flashlight cells and the bulb for intermittently flashing said bulb when the device is switched to the "on" position. One side of the lens may be amber, the other side red, and an indicating directional arrow may also be provided.

7 Claims, 3 Drawing Figures

HAND SAFETY FLASHER

BACKGROUND OF THE INVENTION

1. Field of the Invention

This invention relates generally to safety devices of the hand-held type having mechanism contained therein for causing the device to intermittently light and/or flash.

2. Description of the Prior Art

A common problem with known signalling devices is that they are either "on" or "off" and it is well known that a constant light does not attract one's attention nearly as quickly as one that is intermittent and/or flashing.

Another problem with known devices is that they are not readily hand-held and readily adaptable for use by the great majority of people. Known prior art patents which may be pertinent to this invention are as follows: U.S. Pat. Nos. 1,241,771 filed on Oct. 2, 1917; 1,285,669 filed on Nov. 26, 1918; 1,362,324 filed on Dec. 14, 1920; 1,634,014 filed on June 28, 1927; 2,409,957 filed on Oct. 22, 1946; 3,435,412 filed on Mar. 25, 1969.

None of these known prior art devices offers the new and unique features of the invention disclosed herein.

SUMMARY OF THE INVENTION

An object of the present invention is to provide a hand-held safety flasher device which is easily usable without any degree of skill or advance training necessary by the ordinary worker.

Another object of the present invention is to provide a flasher device which will intermittently turn on a conventional type flashlight bulb mounted behind appropriate lenses of colored, attention attracting structure.

A further object of this invention is to provide a hand-held safety flasher which may be readily fastened and suspended from a person's belt to prevent the loss or misplacement of same.

A still further object of this invention is to provide a hand safety flasher which may be readily adapted for 6-volt or 12-volt operation as the needs and availability arise.

An important feature of the safety flasher device of this invention is that it is hand-held and easily usable by any one in need of a protection or safety device. The flasher will attract attention much more readily than a conventional red or amber colored light because of the fact that it is turning on intermittently. Also the device may be provided with an amber colored lens on one face thereof and a red colored lens on the opposite face thereof for the purpose of indicating caution or danger.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
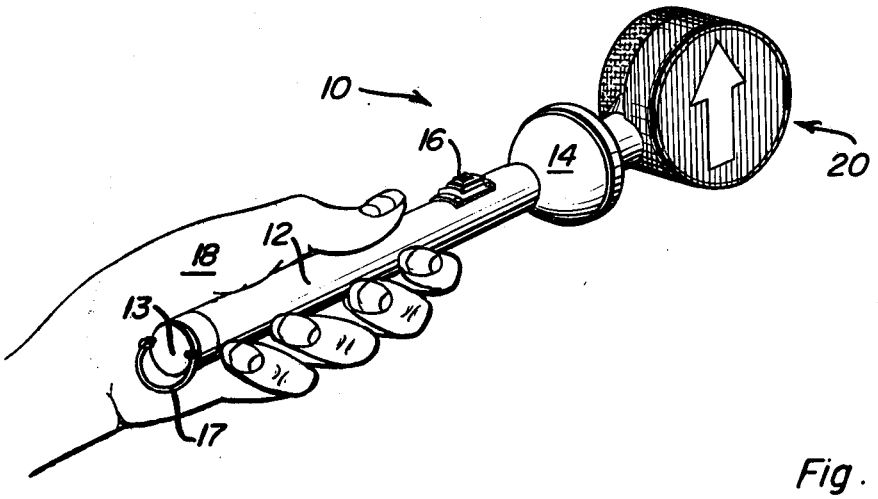
FIG. 1 is a perspective view of the hand safety flasher device of this invention.

Referring to FIG. 1 of the drawing, reference numeral 10 indicates in general the hand safety flasher of this invention as in use. The hand-held safety flasher has a main body receptacle 12 which contains a plurality of single flashlight cells in series for energizing the electrical portion of the overall device. An enlarged head portion 14 is provided at one end of the flashlight cell receptacle and a removable cap 13 screw-threaded or otherwise removably attached is provided for the other end. A switch 16 is mounted upon the exterior surface of the flashlight cell container or receptacle for operation in an "off" and "on" manner. The removable cap 13 has a ring 17 appropriately pivotally mounted thereon for hanging the overall device from one's belt or the like. As shown in FIG. 1 a person's hand 18 is indicated holding the flasher as would be appropriate for directing traffic. The direction and warning indicating portion of the flasher is indicated in FIG. 1 by reference numeral 20.

Figure 2:
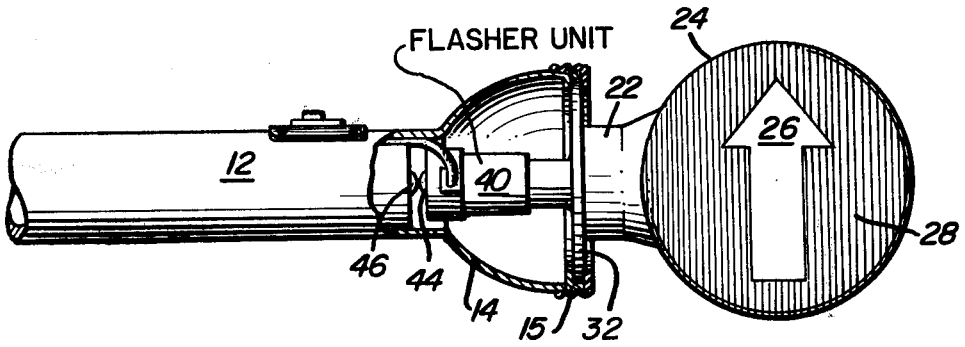
FIG. 2 is a side elevational view, of the main component parts of the hand safety flasher of this invention, partly broken away.
Figure 3:
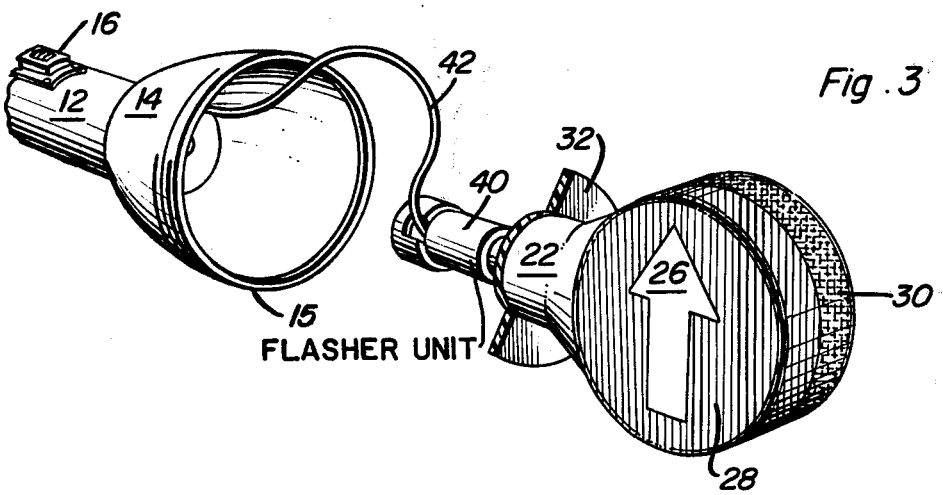
FIG. 3 is an exploded perspective view of the components of the device of this invention.

FIGS. 2 and 3 show the operating structure of this flasher device in cross section and perspective. As seen in FIG. 2 the lens structure 24 has a colored face 28 with a directional arrow 26 indicated thereon. This lens structure is supported by an appropriate support projection 22. Extending from the support projection 22 is a flange 32 which will fit within the head 14 of the handle energizing structure. A removable flange 15, preferably screw-threaded onto the outer edge of the housing 14 supports and retains the flange 32 mounted on the head 14.

A make-and-break type flasher unit 40 is attached to the support structure 22, 32 and appropriately connected electrically, by wires (not shown) to an electric bulb mounted within the lens structure. A wire 42 connects the flasher unit tc the switch 16 internally of the overall structure. Looking at FIG. 2 the internal contact for the center pole of the flasher 40 indicated by numeral 44 is shown as in contact with the plus center pole 46 of the closest flashlight cell. The center portion 46 provides the plus direct current to the flasher unit while the switch 16 connects the wire 42 to the ground side of the batteries in series in a conventional manner internally of the handle structure.

An important feature of this device is that it may be used with several different types of bulbs and flashing units. The body unit 12 may be of sufficient length to hold five 1½ volt flashlight cells in series within same in order to provide a total of 7½ volts. When this voltage is supplied a 6 volt flasher unit 40 and a 6 volt bulb, not shown, will be used. With this arrangement sufficient excess voltage will be supplied to ensure proper operation of the device even when the cells decay a slight amount in overall voltage. The device also may be used with a larger handle receptacle 12 which will contain nine 1½ volt cells and in this sample a 12 volt flasher unit 40 will be used and a 12 volt bulb. In this case 13½ volts will be supplied by the cells in series which is more than sufficient to operate the flasher and bulb structure.

FIG. 3 shows an amber colored lens 28 having a directional arrow 26 provided therein while on the opposite side of the lens structure is a red colored covering 30. Directional arrows 26 may, or may not be provided as desired and with the particular use to which the device is to put in mind. Also a single color type head 20 may be provided, but normally having two colors, such as amber and red, greatly increases the usability and adaptability of the overall device. Normally amber would be used as a caution indicator and caution signal device while the red would be used as a danger signal.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A hand safety flasher device, comprising, in combination:

a. a handle forming main body receptacle having a pair of spaced ends and arrangeable for receiving an electrical energizing cell, the receptacle being provided with an enlarged head portion at one of the ends thereof, the head portion having an opening therein for receiving the cell;

b. an on-off switch mounted on the receptacle and arranged for selectively closing and opening a circuit through the cell received in the receptacle; and c. flasher means mounted on the enlarged head portion, and including a direction and warning indicating portion arranged extending away from the receptacle and a flasher unit extending into the receptacle and contacting a pole of the cell received in the receptacle, an electrical circuit being formed from the cell through the switch, flasher unit, and direction and warning indicating portion.

2. A device as defined in claim 1, wherein the flasher means further includes a lens structure, a support projection connected to the lens structure for supporting same, and a flange arranged extending from the support projection and attached to the flasher unit, the flasher unit and support projection extending in opposite directions from the flange, with the flange being removably disposed within the enlarged head of the receptacle at the opening thereof for mounting the flasher means on the receptacle.

3. A device as defined in claim 2, wherein the lens structure is a lamp electrically connected to the flasher unit and including at least one lens.

4. The structure as set forth in claim 3, wherein two colored lenses are included in the lens structure, with one of said lenses being red in color and the other of said lenses being amber in color.

5. The structure as set forth in claim 4, wherein a directional arrow is included on at least one of the lenses.

6. The structure as set forth in claim 5, wherein the entire structure is of metal and an end of the receptacle opposite to the lens mount is removable and has a belt-engaging loop attached thereto for the purpose of suspending the overall flasher device from a person's belt.

7. The structure as set forth in claim 5, wherein the entire structure, except for the electrical wiring and connections thereof is made of plastic material so that the device may be used by electricians and the like without any danger of electrical shock, and further including an electrical wire connected to the flasher unit and electrically connectible to another pole of the cell than the pole which the flasher unit contacts.

* * * * *